US008342904B2

(12) United States Patent
Torres

(10) Patent No.: US 8,342,904 B2
(45) Date of Patent: Jan. 1, 2013

(54) TOY VEHICLES

(75) Inventor: Ronald Torres, Hacienda Heights, CA (US)

(73) Assignee: Mattel, Inc., El Segundo, CA (US)

( * ) Notice: Subject to any disclaimer, the term of this patent is extended or adjusted under 35 U.S.C. 154(b) by 442 days.

(21) Appl. No.: 12/100,341

(22) Filed: Apr. 9, 2008

(65) Prior Publication Data

US 2008/0261487 A1 Oct. 23, 2008

Related U.S. Application Data

(63) Continuation-in-part of application No. 29/306,315, filed on Apr. 7, 2008, now Pat. No. Des. 593,163.

(60) Provisional application No. 61/020,121, filed on Jan. 9, 2008, provisional application No. 61/019,822, filed on Jan. 8, 2008, provisional application No. 60/925,493, filed on Apr. 20, 2007.

(30) Foreign Application Priority Data

| | | |
|---|---|---|
| Jan. 9, 2008 | (HK) | 0800054.1 |
| Jan. 10, 2008 | (CN) | 2008 3 0002180 |
| Jan. 25, 2008 | (EM) | 000864913-0001 |
| Jan. 25, 2008 | (EM) | 000898820-0001 |

(51) Int. Cl.
*A63H 17/00* (2006.01)

(52) U.S. Cl. ..... 446/448

(58) Field of Classification Search ..... 446/448, 446/447, 427, 290, 287, 286, 274
See application file for complete search history.

(56) References Cited

U.S. PATENT DOCUMENTS

| | | | | |
|---|---|---|---|---|
| 2,775,062 | A | | 12/1956 | Gibson, Jr. et al. |
| 3,001,601 | A | | 9/1961 | Aghnides |
| 3,237,343 | A | | 3/1966 | Blanchard |
| 3,600,847 | A | | 8/1971 | Lakin |
| 4,540,376 | A | | 9/1985 | Turbowitz et al. |
| 4,547,166 | A | | 10/1985 | Goldfarb et al. |
| 4,652,247 | A | | 3/1987 | Goldfarb et al. |
| 4,705,487 | A | * | 11/1987 | Ishimoto ..... 446/290 |
| 4,744,781 | A | | 5/1988 | Ostendorff et al. |
| 4,767,376 | A | | 8/1988 | Hanzawa |

(Continued)

OTHER PUBLICATIONS

WIPO; International Preliminary Report on Patentability dated Oct. 20, 2009.

(Continued)

*Primary Examiner* — Gene Kim
*Assistant Examiner* — Amir Klayman
(74) *Attorney, Agent, or Firm* — Kolisch Hartwell, PC

(57) ABSTRACT

A toy vehicle configured to move across a support surface is disclosed. In some embodiments, the toy vehicle may include a body having a top portion and a bottom portion; a plurality of wheels rotatably mounted to the body and configured to rotatably support the body on the support surface in a plurality of positions including an upright position, and an inverted position, wherein less than all of the plurality of wheels rotatably support the body on the support surface when the body is in the inverted position; and a stabilizing mechanism mounted to the body, the stabilizing mechanism being configured, when the body is in the inverted position, to move a portion of the body away from the support surface such that one or more of the plurality of wheels may be driven to return the body in the upright position.

16 Claims, 8 Drawing Sheets

U.S. PATENT DOCUMENTS

| | | | |
|---|---|---|---|
| 4,773,889 | A | 9/1988 | Rosenwinkel et al. |
| 4,902,260 | A | 2/1990 | Im |
| 5,019,009 | A | 5/1991 | Chao-Chin et al. |
| 5,334,078 | A | 8/1994 | Hippely et al. |
| 5,487,692 | A | 1/1996 | Mowrer et al. |
| 5,580,296 | A | 12/1996 | Chow |
| 5,618,219 | A | 4/1997 | Simone et al. |
| 5,727,985 | A | 3/1998 | George et al. |
| 5,803,790 | A | 9/1998 | Tilbor et al. |
| 6,129,607 | A | 10/2000 | Hoeting et al. |
| 6,227,934 | B1 | 5/2001 | Isaksson et al. |
| 6,439,948 | B1 | 8/2002 | Ostendorff et al. |
| 6,502,657 | B2 | 1/2003 | Kerrebrock et al. |
| 6,540,583 | B1 | 4/2003 | Hoeting et al. |
| 6,551,169 | B2 | 4/2003 | Jaffe |
| 6,589,098 | B2 | 7/2003 | Lee et al. |
| 6,648,722 | B2 | 11/2003 | Lynders et al. |
| 6,692,333 | B2 | 2/2004 | Kislevitz et al. |
| 6,939,197 | B1 * | 9/2005 | Hoeting ..... 446/437 |
| D527,772 | S | 9/2006 | Bowen et al. |
| D529,967 | S | 10/2006 | Bowen et al. |
| 7,172,488 | B2 | 2/2007 | Moll et al. |
| 7,217,170 | B2 | 5/2007 | Moll et al. |
| D566,788 | S | 4/2008 | Pasko |
| 2003/0082990 | A1 | 5/2003 | Lynders et al. |
| 2003/0224695 | A1 | 12/2003 | Kislevitz et al. |
| 2004/0092206 | A1 | 5/2004 | Lynders et al. |
| 2006/0089080 | A1 | 4/2006 | Moll et al. |

OTHER PUBLICATIONS

The State Intellectual Property Office of the People's Republic of China, Office Action, May 2, 2012, 16 pages.

Mattel, Inc., "Swamp Rat," catalog, 1987, p. 117.

* cited by examiner

TOY VEHICLES

CROSS-REFERENCE TO RELATED APPLICATIONS

This application is a continuation-in-part of U.S. Design Patent Application Ser. No. 29/306,315 entitled "Toy Vehicle," filed Apr. 7, 2008 now U.S. Pat. No. D,593,163. Additionally, this application claims priority under 35 U.S.C. §119(a)-(d) to European Community Design Application Nos. 000864913-0001 and 000898820-0001 entitled "Vehicle Toy" and "Remote Control," respectively, both filed Jan. 25, 2008 with the Designs Department of the Office for Harmonization in the Internal Market. Moreover, this application claims priority under 35 U.S.C. §119(a)-(d) to Chinese Design Application No. 200830002180.2 entitled "Toy Vehicles," which was filed on Jan. 10, 2008 with the State Intellectual Property Office of the People's Republic of China. Furthermore, this application claims priority under 35 U.S.C. §119(a)-(d) to Hong Kong Design Application No. 0800054.1 entitled "Toy Vehicle," which was filed on Jan. 9, 2008 with the Designs Registry of the Intellectual Property Department of the Government of the Hong Kong Special Administrative Region. The Hong Kong, Chinese, and European applications were filed under the Paris Convention for the Protection of Industrial Property, which Hong Kong, China, Europe, and the United States are contracting parties of. Finally, this application claims priority under 35 U.S.C. §119(e) to U.S. Provisional Patent Application Ser. No. 60/925,493 entitled "Toy Vehicles," filed Apr. 20, 2007. The complete disclosures of the above applications are herein incorporated by reference for all purposes. Additionally, this application claims priority under 35 U.S.C. §119(e) to U.S. Provisional Patent Application Ser. No. 61/020,121 entitled "Toy Vehicles," filed Jan. 9, 2008 and U.S. Provisional Patent Application Ser. No. 61/019,822 entitled "Toy Vehicles," filed Jan. 8, 2008.

Additionally, this application claims priority under 35 U.S.C. §119(e) to U.S. Provisional Patent Application Ser. No. 61/020,121 entitled "Toy Vehicles," filed Jan. 9, 2008 and U.S. Provisional Patent Application Ser. No. 61/019,822 entitled "Toy Vehicles," filed Jan. 8, 2008.

BACKGROUND OF THE DISCLOSURE

The present disclosure is directed to toy vehicles, particularly toy vehicles that are configured to move on a variety of surfaces and/or include one or more stabilizing mechanisms. Examples of toy vehicles, including toy vehicles that are configured to move on a variety of surfaces and/or include one or more stabilizing mechanisms include U.S. Pat. Nos. 7,172,488; 6,939,197; 6,692,333; 6,648,722; 6,540,583; 6,502,657; 6,439,948; 6,227,934; 6,129,607; 5,618,219; 5,487,692; 5,019,009; 4,902,260; 4,773,889; 4,767,376; 4,744,781; 4,652,247; 4,547,166; 4,540,376; 3,600,847; 3,237,343; 3,001,601; 2,775,062; D529,967; and D527,772, and U.S. Patent Application Publication Nos. 2006/0089080; 2004/0092206; 2003/0224695; and 2003/0082990. The complete disclosures of the above patents and patent applications are herein incorporated by reference for all purposes.

SUMMARY OF THE DISCLOSURE

Some embodiments provide a toy vehicle configured to move across a support surface. In some embodiments, the toy vehicle may include a body having a top portion and a bottom portion; a plurality of wheels rotatably mounted to the body and configured to rotatably support the body on the support surface in a plurality of positions including an upright position in which the bottom portion is adjacent the support surface and the top portion is spaced from the support surface relative to the bottom portion, and an inverted position in which the top portion is adjacent the support surface and the bottom portion is spaced from the support surface relative to the top portion, wherein less than all of the plurality of wheels rotatably support the body on the support surface when the body is in the inverted position; and a stabilizing mechanism mounted to the body, the stabilizing mechanism being configured, when the body is in the inverted position, to move a portion of the body away from the support surface such that one or more of the plurality of wheels may be driven to return the body in the upright position.

In some embodiments, the toy vehicle may include a body having a top portion and a bottom portion; a plurality of wheels rotatably mounted to the body and configured to rotatably support the body on the support surface in a plurality of positions including an upright position in which the bottom portion is adjacent the support surface and the top portion is spaced from the support surface relative to the bottom portion, and in an inverted position in which the top portion is adjacent the support surface and the bottom portion is spaced from the support surface relative to the top portion, the plurality of wheels including front wheels and rear wheels, wherein only the front wheels rotatably support the body on the support surface when the body is in the inverted position; and a stabilizing mechanism mounted to the body, the stabilizing mechanism being configured, when the body is in the inverted position, to move a portion of the body adjacent the rear wheels away from the support surface such that the front wheels may be driven to return the body in the upright position.

In some embodiments, the toy vehicle may include a body having a top portion and a bottom portion; a plurality of wheels rotatably mounted to the body and configured to rotatably support the body on the support surface in a plurality of positions including an upright position in which the bottom portion is adjacent the support surface and the top portion is spaced from the support surface relative to the bottom portion, and in an inverted position in which the top portion is adjacent the support surface and the bottom portion is spaced from the support surface relative to the top portion, the plurality of wheels including front wheels and rear wheels, wherein the rear wheels do not rotatably support the body on the support surface when the body is in the inverted position; a drive assembly configured to receiving driving inputs from a user and to convey the driving inputs to one or more of the plurality of wheels; and a stabilizing mechanism mounted to the body, the stabilizing mechanism being configured, when the body is in the inverted position, to move a portion of the body with the rear wheels away from the support surface such that the front wheels may be driven to return the body in the upright position.

DETAILED DESCRIPTION OF THE DISCLOSURE

Figure 1:
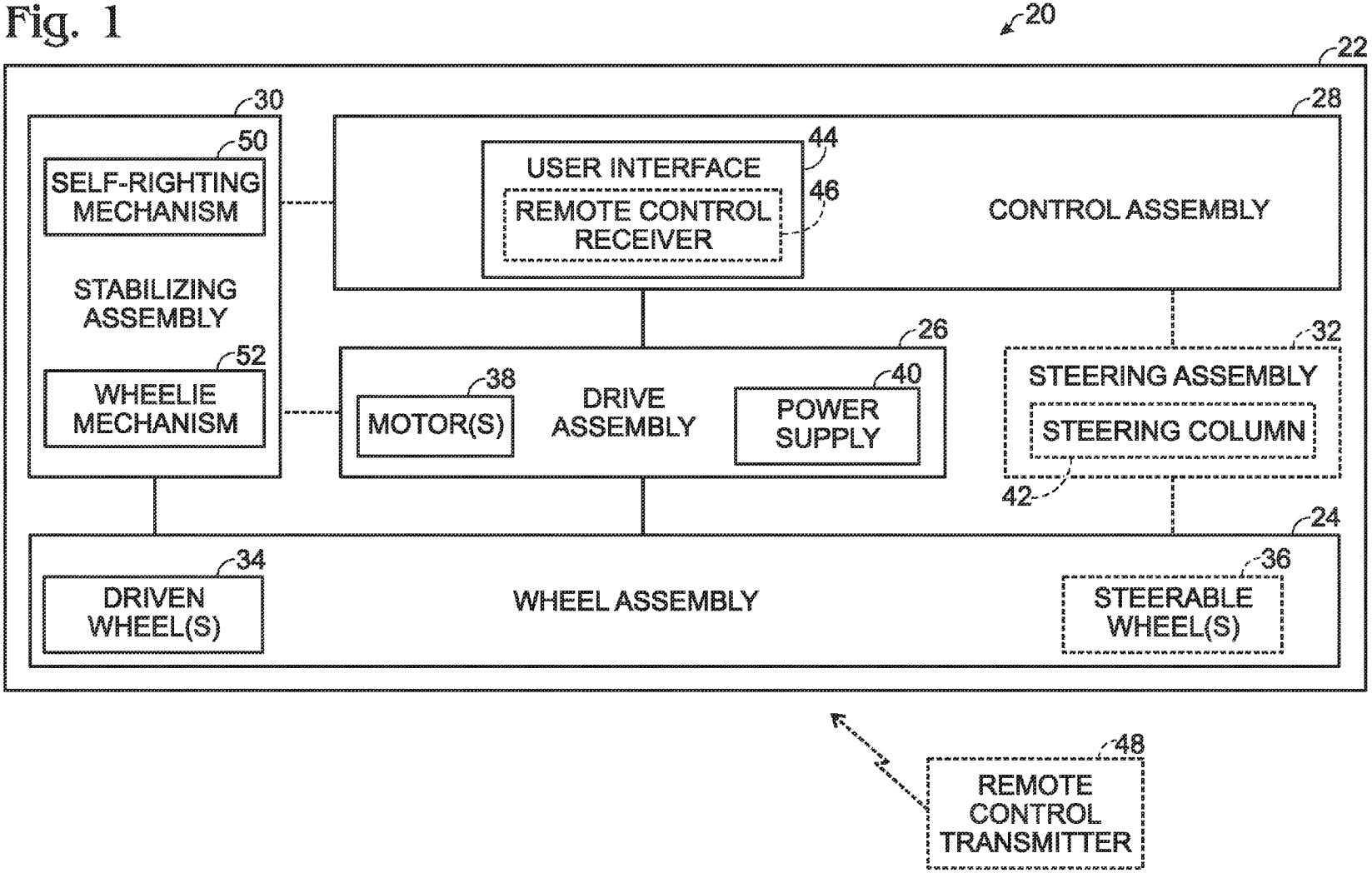
FIG. 1 shows a schematic view of some embodiments of a toy vehicle.

FIG. 1 shows some embodiments of a toy vehicle 20. The toy vehicle may include any suitable structure configured to allow the toy vehicle to move across any suitable support surface(s). For example, the toy vehicle may include a body 22, a wheel assembly 24, a drive assembly 26, a control assembly 28, and a stabilizing assembly 30. In some embodiments, the toy vehicle may additionally, or alternatively, include a steering assembly 32.

The body may include any suitable structure configured to support one or more other components of the toy vehicle. Additionally, the body may have any suitable shape and/or any suitable appearance. In some embodiments, the body may include one or more structures configured to ensure that the vehicle floats on water, such as one or more foam members (e.g., closed cell foam, etc.).

Wheel assembly 24 may include a plurality of wheels rotatably mounted to the body and/or configured to rotatably support the body on one or more support surfaces in a plurality of positions. For example, the plurality of wheels may include at least one driven wheel 34. In some embodiments, the plurality of wheels may alternatively, or additionally, include at least one steerable wheel 36. The driven wheel may be configured to be driven by drive assembly 26 at any suitable speed(s) and/or direction(s). Steerable wheel 36 may be configured to be steered by steering assembly 32 toward any suitable direction(s).

The wheel assembly may include any suitable number of wheels, such as two wheels, three wheels, four or more wheels. Any combination of those wheels may be driven and/or steerable. For example, when the plurality of wheels includes two front wheels and two rear wheels, all wheels may be driven (all-wheel drive configuration) with one or more of those wheels being steerable. Alternatively, the two front wheels may be steerable and the two rear wheels may be driven (rear-wheel drive configuration), or vice-versa (front-wheel drive configuration).

Alternatively, all wheels may be driven but none of the wheels may be steerable. For example, the drive assembly may selectively and independently drive each of at least two pairs of a front wheel and a rear wheel, which may be referred to as tank-drive configuration. In a tank-drive configuration, the toy vehicle may be steered by selective rotation of the driven wheels, even though none of its wheels are steerable.

The wheels may include any suitable structure configured to allow the body to move across one or more support surfaces, such as asphalt, concrete, clay, sand, soil, brick, tile, carpet, and/or other outdoor/indoor support surfaces. In some embodiments, one or more of the wheels may include one or more structures configured to ensure that the vehicle floats on water, such as one or more foam members (e.g., closed cell foam, etc.).

Drive assembly 26 may include any suitable structure configured to selectively drive the rotation of the at least one driven wheel. For example, the drive assembly may include at least one motor 38 and at least one power supply 40. The motor may be configured to drive the rotation of at least one of the driven wheels of the plurality of wheels.

Drive assembly 26 may include any suitable number of motors 38. For example, the drive assembly may include two motors where a first motor may drive a subset of the plurality of wheels, such as a first pair of a front wheel and a rear wheel (or the front wheels), while a second motor may drive another subset of the plurality of wheels, such as a second pair of a front wheel and a rear wheel (or the rear wheels). Alternatively, drive assembly 26 may include more than two motors. For example, drive assembly 26 may include a motor for each driven wheel.

Motor 38 may additionally power other moveable components of vehicle 20. For example, the motor may power one or more components of stabilizing assembly 30. In some embodiments, the motor may activate a wheelie mechanism and/or self-right mechanism of the stabilizing assembly. For example, the motor may move one or more stabilizers of the stabilizing assembly toward an extended position and/or a retracted position.

Power supply 40 may include any suitable structure configured to provide power for the motor, such as one or more batteries, capacitors, etc. The drive assembly may additionally, or alternatively, be configured to receive driving inputs from a user, such as via control assembly 28, and to convey those driving inputs to the plurality of wheels. Although drive assembly 26 is shown to include motor 38 and power supply 40, the drive assembly may additionally, or alternatively, include any suitable components and/or assemblies configured to selectively drive the rotation of the at least one driven wheel, such as motor output linkage(s), user input device(s), etc.

Control assembly 28 may include any suitable structure configured to receive user inputs and/or to convey those inputs to drive assembly 26 and/or steering assembly 32. For example, control assembly 28 may include a user interface 44 configured to receive user inputs, such as driving and/or steering inputs. The user interface may include control knob(s), button(s), lever(s), cord(s), keyboard(s), etc.

The control assembly may sometimes be referred to as being configured to be in control communication with the drive and/or steering assemblies. "Control communication," as used herein, refers to the control assembly being physically connected, remotely connected, and/or connected in other suitable way(s) to allow the control assembly to convey user inputs to one or more other components of the toy vehicle, such as the drive and/or steering assemblies.

In some embodiments, the user interface may include a remote control receiver 46 and a remote control transmitter 48. The remote control transmitter may be configured to receive user inputs, such as drive and/or steering inputs, and to transmit those inputs to the remote control receiver. Remote control transmitter 48 may include control knob(s), button(s), lever(s), cord(s), keyboard(s), etc. Remote control receiver 46 may receive those inputs and convey those inputs to the drive assembly and/or steering assembly.

In some embodiments, remote control transmitter 48 may be cordless or not physically connected with remote control receiver 46 and/or toy vehicle 20. In those embodiments, remote control transmitter 48 may communicate with remote control receiver 46 via electromagnetic radiation, such as one or more infrared beams, one or more radio signals, one or more microwave beams, etc. Alternatively, remote control transmitter 48 may be connected via one or more cables or cords to remote control receiver 46 and/or toy vehicle 20.

Although control assembly 28 is shown to convey user inputs to drive assembly 26 and steering assembly 32, the control assembly may additionally, or alternatively, convey user inputs to other components of the toy vehicle, such as stabilizing assembly 30. For example, the control assembly may move one or more stabilizers of the stabilizing assembly toward an extended position and/or a retracted position.

Stabilizing assembly 30 may include any suitable structure configured to stabilize and/or self-right the body of the toy vehicle. For example, stabilizing assembly 30 may include a self-righting mechanism 50 and a wheelie mechanism 52. Self-righting mechanism 50 may include any suitable structure configured to self-right the body of the toy vehicle and/or move the body toward one or more positions relative a support surface. Wheelie mechanism 52 may include any suitable structure configured to support the body in a wheelie position or a position in which only one or more rear wheels rotatably support the body on a support surface.

Stabilizing assembly 30 may be operatively connected to the wheel assembly such that movement of one or more wheels of the wheel assembly triggers one or more components of the stabilizing assembly. Alternatively, or additionally, one or more components of the stabilizing assembly may be operatively connected to the drive assembly, the steering assembly, and/or the control assembly. For example, self-righting mechanism may be activated via user inputs through the control assembly.

Steering assembly 32 may include any suitable structure configured to selectively steer the at least one steerable wheel. For example, the steering assembly may include at least one steering column 42 and/or other mechanical linkage that receives steering inputs from control assembly 28 and steers one or more of the steerable wheels based, at least in part, on the steering inputs. Although steering assembly 32 is shown to include steering column 42, the steering assembly may additionally, or alternatively, include any suitable structure configured to selectively steer the at least one steerable wheel. Although toy vehicle 20 is shown to include body 22, wheel assembly 24, drive assembly 26, control assembly 28, stabilizing assembly 30, and steering assembly 32, the toy vehicle may additionally, or alternatively, include any suitable structure configured to allow the toy vehicle to move across any suitable surface(s).

Figure 2:
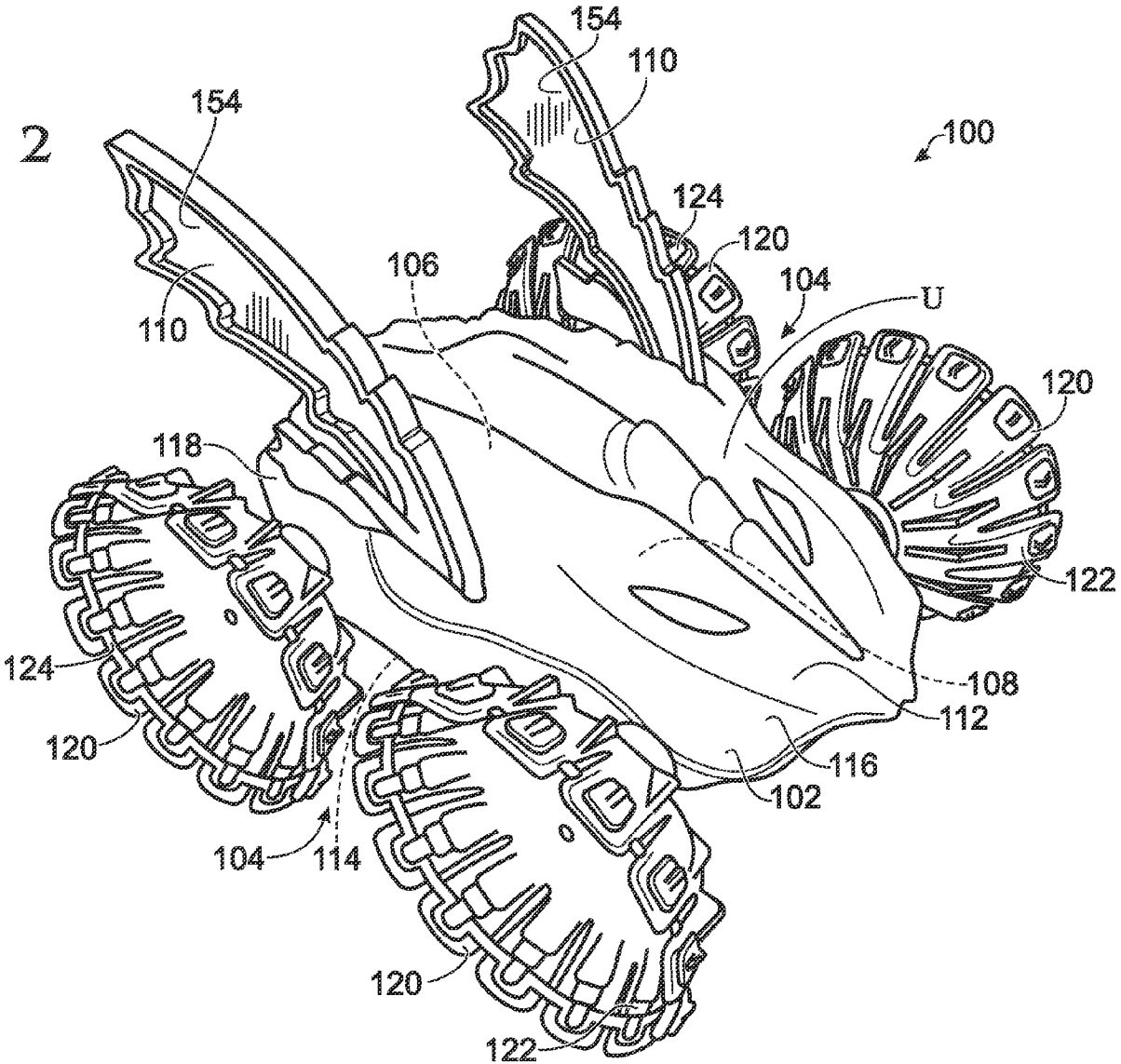
FIG. 2 shows an isometric view of an illustrative example of the toy vehicle of FIG. 1.
Figure 3:
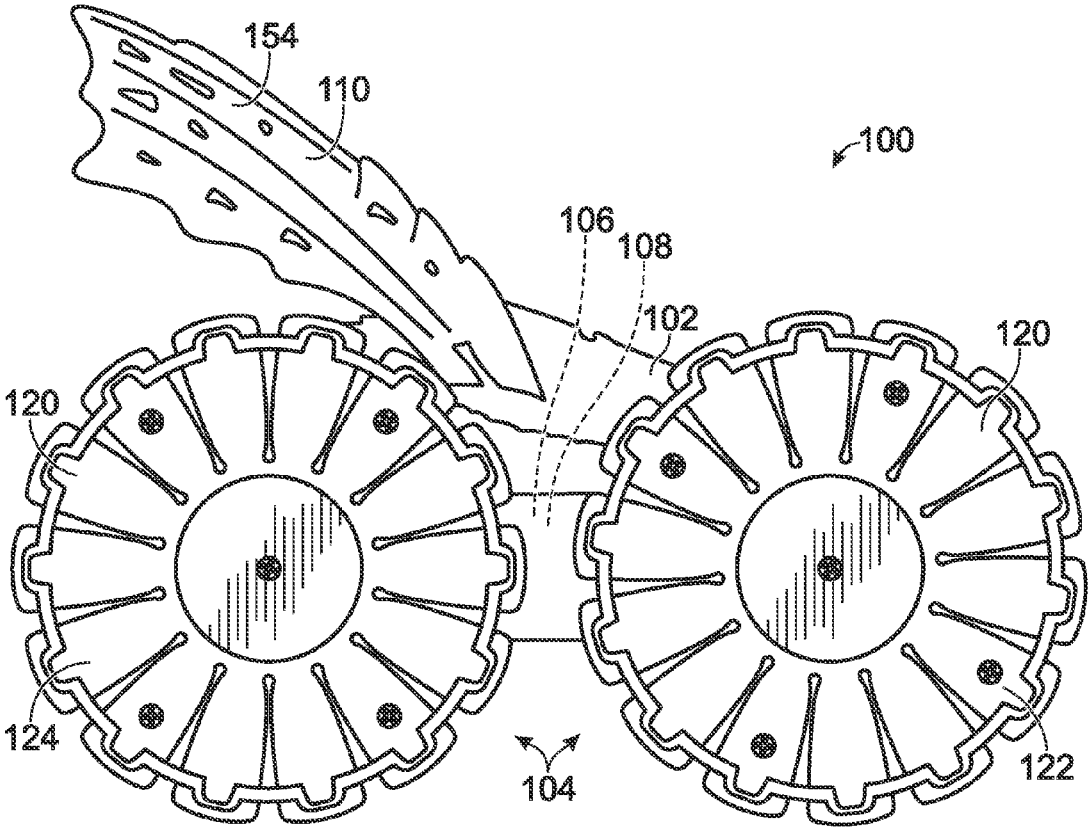
FIG. 3 shows a side view of the toy vehicle of FIG. 2.

An example of toy vehicle 20 is shown in FIGS. 2-3 and is generally indicated at 100. Unless specifically excluded, toy vehicle 100 may include one or more components and/or one or more functions of components of toy vehicle 20. The toy vehicle may include a body 102, a wheel assembly 104, a drive assembly 106, a control assembly 108, and a stabilizing assembly 110.

The body may include any suitable portions, such as a top portion 112, a bottom portion 114, a front portion 116, and a rear portion 118. Additionally, body 102 may have any suitable shape(s) and/or appearance(s). For example, the body may have a curvilinear shape and may have the appearance of a toy alien beast, as shown in FIG. 2.

Although the body is shown to have a particular curvilinear shape, the body may alternatively, or additionally, have any suitable curvilinear, rectilinear, and/or other suitable shape(s). Additionally, although the body is shown to have the appearance of an alien beast, the body may alternatively, or additionally, have any suitable appearance(s). For example, the body may alternatively have the appearance of a particular car, sport-utility vehicle, and/or truck.

Wheel assembly 104 may include a plurality of wheels 120, which may be rotatably mounted to the body and may be configured to rotatably support the body on a support surface in a plurality of positions. For example, the plurality of wheels may be configured to rotatably support body 102 in an upright position U in which the bottom portion of the body may be adjacent the support surface, and the top portion of the body may be spaced from the support surface relative to the bottom portion, as shown in FIGS. 2-3.

Figure 6:
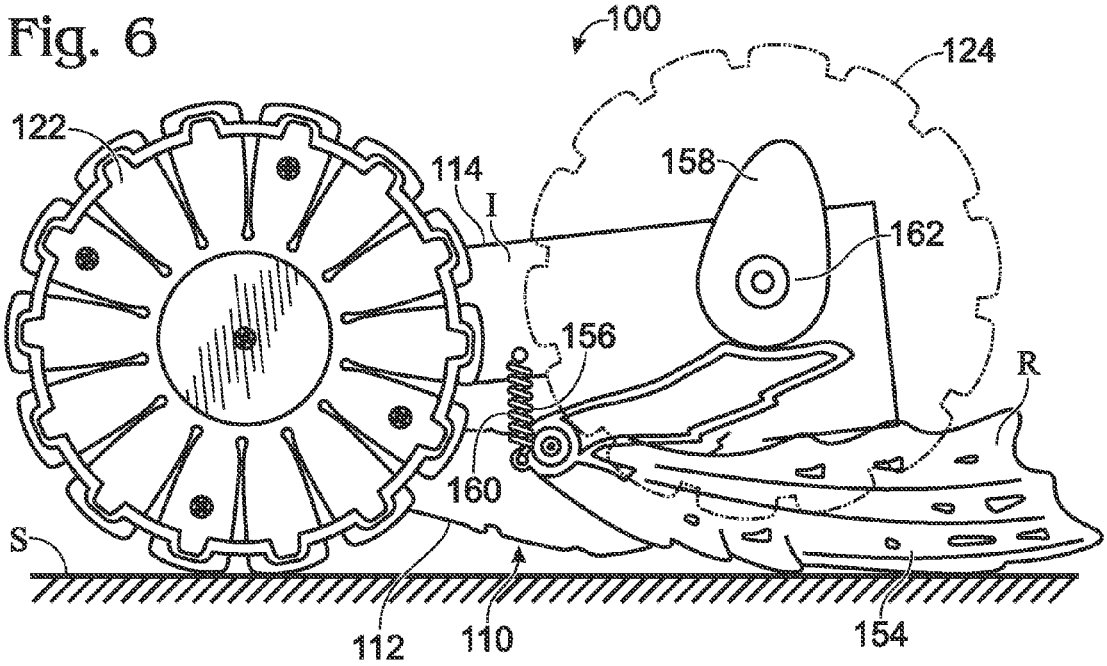
FIGS. 6-9 show side views of the toy vehicle of FIG. 2 in an inverted position on a support surface, shown without a rear wheel to illustrate operation of a stabilizing assembly.
Figure 12:
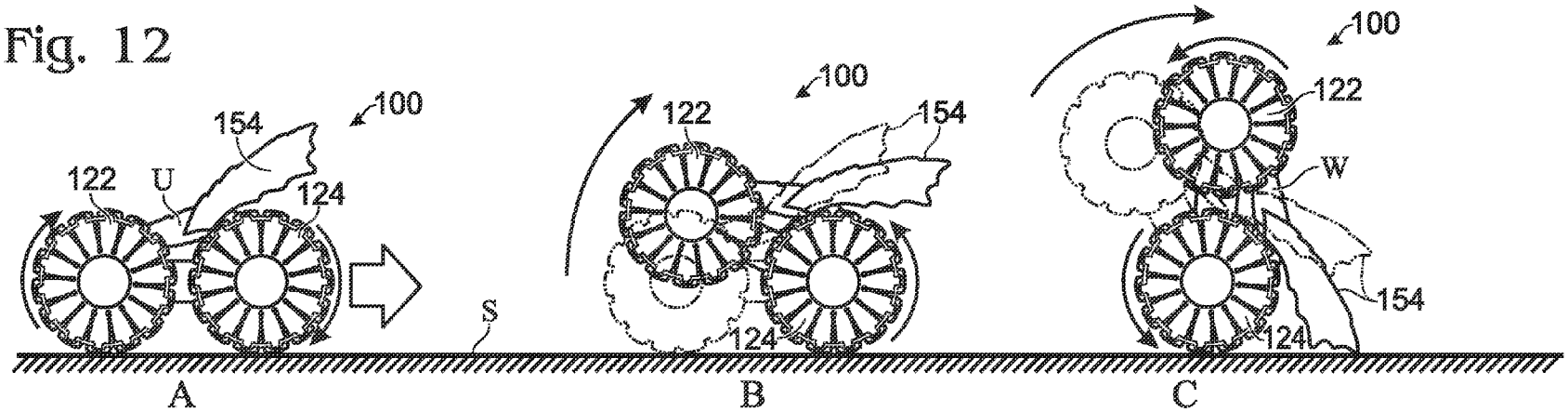
FIG. 12 shows side views of the toy vehicle of FIG. 2 as the toy vehicle moves from an upright position to a "wheelie" position on a support surface.
Figure 13:
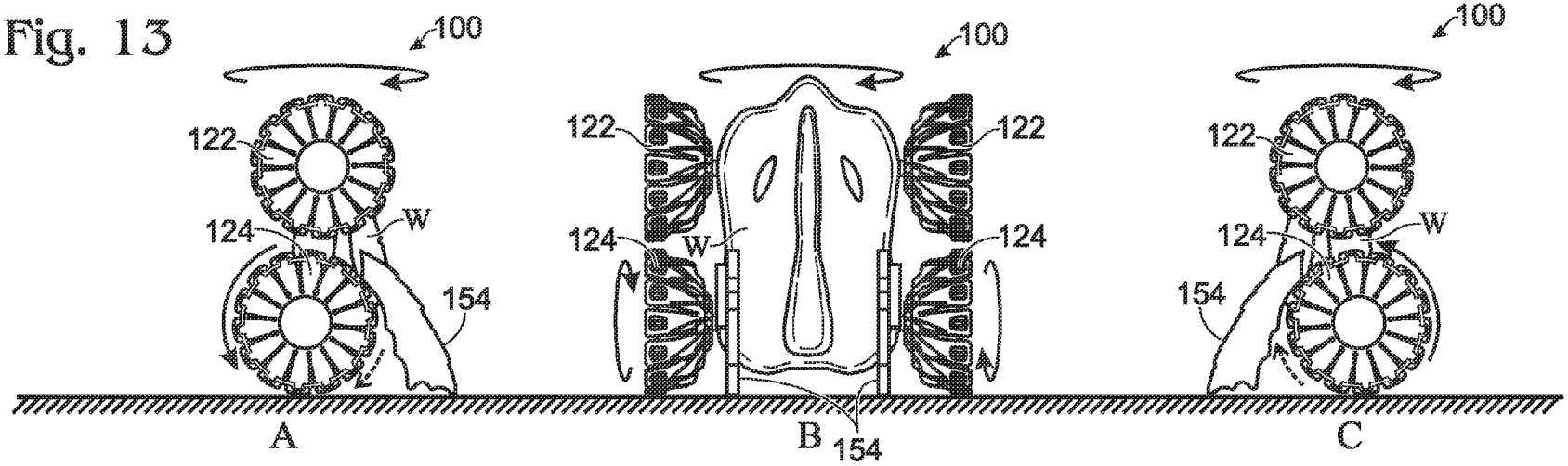
FIG. 13 shows various views of the toy vehicle of FIG. 2 as the toy vehicle rotates while in a "wheelie" position on a support surface.

Additionally, or alternatively, the plurality of wheels may be configured to rotatably support body 102 in an inverted position I in which top portion 112 is adjacent a support surface S and bottom portion 114 is spaced from the support surface relative to the top portion, as shown in FIG. 6. In some embodiments, less than all of the plurality of wheels (such as only the front wheels) may rotatably support the body on the support surface when the body is in the inverted position. Alternatively, or additionally, the plurality of wheels may be configured to rotatably support body 102 in a wheelie position W in which only one or more rear wheels rotatably support body 102, as shown in FIGS. 12-13.

Plurality of wheels 120 may include any suitable shape(s) and/or size(s). For example, one or more of the plurality of wheels may be concave-shaped or hemispherical-shaped, as shown in FIGS. 2-3. Alternatively, or additionally, one or more of the plurality of wheels may be spherical-shaped, cylindrically-shaped, convex-shaped, etc. One or more of the plurality of wheels may be equal or about equal in size. Alternatively, the plurality of wheels may include two or more wheels of different sizes. For example, plurality of wheels 120 may include one small front wheel and two large rear wheels, such as rear wheels that are about two to three times the diameter of the front wheel.

The plurality of wheels may include front wheels 122 and rear wheels 124, as shown in FIGS. 2-3. In some embodiments, the plurality of wheels may be referred to as including at least two pairs of front wheel 122 and rear wheel 124. Although plurality of wheels 120 is shown to include two front wheels 122 and two rear wheels 124, the plurality of wheels may include any suitable number of front and/or rear wheels, such as one, three, or four front wheels and/or one, three, or four rear wheels.

Figure 4:
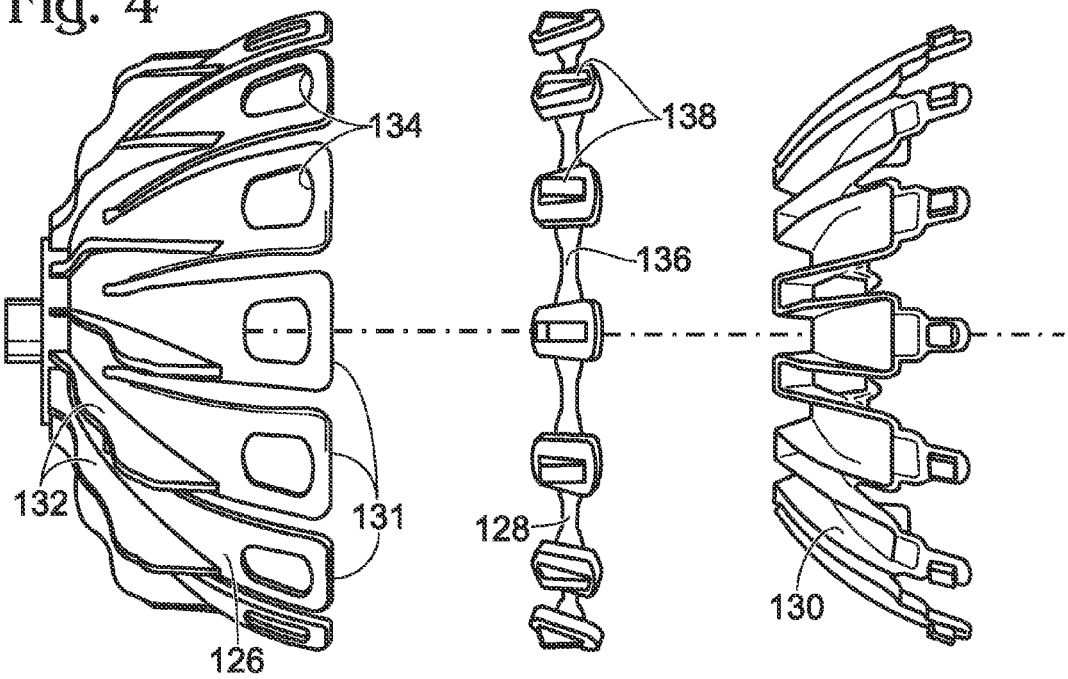
FIG. 4 shows an exploded view of an illustrative example of the wheels of the toy vehicle of FIG. 2.

Front and rear wheels 122 and 124 may include any suitable structure configured to rotatably support the body and allow the body to move across one or more support surfaces. For example, one or more of the wheels may include a base 126, a traction nub ring 128, and a retainer hub 130, as shown in FIG. 4. The base may include a plurality of petals 131, a plurality of paddles 132, and a plurality of apertures 134. The paddles may increase traction and/or grip on more variable support surfaces and/or allow the body to move across bodies of water. Apertures 134 may be sized to receive traction nubs from traction nub ring 128.

The traction nub ring may include a ring 136 and a plurality of traction nubs 138. The ring may support the plurality of traction nubs in a spaced relationship, while the traction nubs may increase traction and/or grip on various support surfaces. Retainer hub 130 may be configured to be mounted on base 126 and to maintain traction nub ring 128 on base 126.

Although wheels 120 are shown to include discrete components, one or more components may be incorporated or combined into and/or onto other components. For example, traction nubs 138 may be incorporated, such as inserted molded, onto the petals of the base. Additionally, although each petal of the base is shown to include a single traction nub, one or more of the petals may include two or more traction nubs (or include no traction nubs). Moreover, although traction nubs 138 are shown to include a particular shape and size, one or more of the traction nubs may include any suitable shape(s) and size(s).

Figure 5:
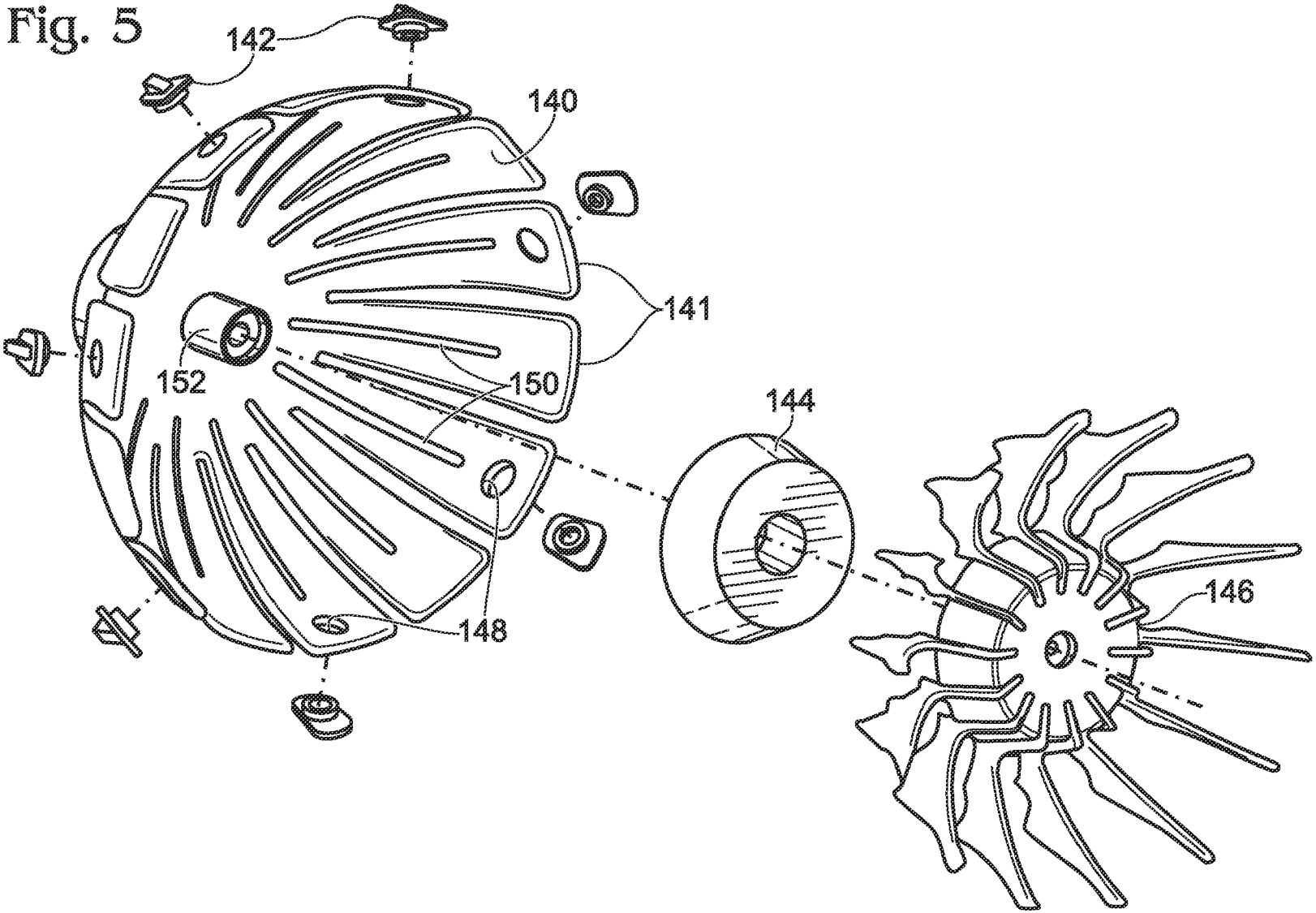
FIG. 5 shows an exploded view of another illustrative example of the wheels of the toy figure of FIG. 2.

Furthermore, although wheels 120 are shown to include base 126, traction nub ring 128, and retainer hub 130, one or more of the wheels may alternatively, or additionally, include any suitable structure configured to rotatably support body 102 on one or more support surfaces and allow the body to move across those surfaces. For example, one or more wheels 120 may include a base 140, a plurality of petals 141, traction nubs 142, a floatation device 144, and a paddle wheel 146, as shown in FIG. 5.

Base 140 may include a plurality of openings 148, a plurality of slits 150, and a protruding portion 152. The plurality of apertures may be sized to receive the traction nubs, while the plurality of slits may be sized to allow paddles of the paddle wheel to extend through the base. Protruding portion 152 may be configured to receive the flotation device and paddle wheel. Floatation device 144 and paddle wheel 146 may be configured to be attached to protruding portion 152.

Drive assembly 106 and control assembly 108 may include one or more components and/or one or more functions of components of drive assembly 26 and control assembly 28, respectively. For example, drive assembly 106 may include two motors (not shown) to selectively and independently drive each of at least two pairs of a front wheel and a rear wheel of the plurality of wheels.

Stabilizing assembly 110 may include any suitable structure configured to stabilize and/or self-right toy vehicle 100. Additionally, or alternatively, the stabilizing assembly may include any suitable structure configured, when body 102 is in inverted position I, to move a portion of the body away from the support surface such that one or more of the plurality of wheels (such as the front wheels) may be driven to return the body in upright position U. For example, the stabilizing assembly may include at least one stabilizer 154, at least one bias assembly 156, and at least one lifter 158, as shown in FIGS. 6-9.

The stabilizer may be movably connected to body 102, such as pivotally-connected. Stabilizer 154 may be configured to move or pivot among a plurality of positions, such as between a retracted position R in which the stabilizer is adjacent the body, and an extended position E in which the stabilizer is spaced from the body relative to the retracted position.

The stabilizer may move any suitable portion(s) of the body away from the support surface as that bar moves from the retracted position toward the extended position, such as from urging from the bias assembly. For example, the stabilizer may move a portion of the body that is adjacent one or more of the plurality of wheels that do not rotatably support the body on the support surface when the body is in the inverted position, such as the portion adjacent the rear wheels. Additionally, or alternatively, stabilizer 154 may contact the support surface when body 102 is in the inverted position, such as to prevent the one or more of the plurality of wheels from rotatably supporting the body when in the inverted position, as shown in FIGS. 6-9. For example, stabilizer 154 may contact the support surface to prevent the rear wheels from rotatably supporting the body when the body is in the inverted position.

Stabilizing assembly 110 may include any suitable number of stabilizers, such as one, two, three, or four bars. Additionally, the stabilizer may be any suitable shape(s) and/or size(s). For example, the stabilizer may be shaped as a two-pronged wing as shown in FIGS. 6-9. Moreover, when stabilizing assembly 110 includes two or more stabilizers, those bars may have different shape(s) and/or size(s). Furthermore, stabilizer 154 may be movably connected on any suitable portion(s) of body 102. For example, the stabilizer may be movably connected between the front and rear wheels of the body.

Although stabilizing assembly 110 is shown to include two stabilizers, the stabilizing assembly may have any suitable number of stabilizers. For example, stabilizing assembly 110 may have a single stabilizer or may have three stabilizers. Additionally, although stabilizers 154 are shown to have a two-pronged wing shape, one or more of the stabilizers may have any suitable shape(s).

Moreover, although stabilizers 154 are shown to be pivotally connected to body 102, one or more of those bars may alternatively, or additionally, be sliding and/or rotatably connected. Furthermore, although stabilizers 154 are shown to be configured to move a rear portion of the toy vehicle, one or more of the stabilizers may alternatively, or additionally, be configured to move one or more other suitable portion(s) of the toy vehicle. For example, one or more of the stabilizers may be configured to move one or more side portion(s) of the toy vehicle, such as when the toy vehicle lands on one of its side portions. Alternatively, or additionally, one or more of the stabilizers may be configured to move the entire toy vehicle away from the support surface (such as propelling the entire toy vehicle into the air).

Bias assembly 156 may include any suitable structure configured to urge stabilizer 154 toward the extended position. For example, the bias assembly may include at least one coil spring 160, as shown in FIGS. 6-9. In some embodiments, stabilizer 154 may be configured to move to the retracted position against the urging of the bias assembly when the body is in the inverted position.

Although bias assembly 156 is shown to include coil spring 160, the bias assembly may include any suitable structure configured to urge stabilizer 154 toward the extended position. For example, bias assembly 156 may alternatively, or additionally, include piano wire(s), leaf spring(s), and/or other elastic device(s). Additionally, although bias assembly 156 is shown to include a single coil spring, the bias assembly may include any suitable number of springs, such as two, three, or four springs. Moreover, although bias assembly 156 is shown to be configured to urge stabilizer 154 toward the extended position, the bias assembly may alternatively, or additionally, be configured to urge stabilizer toward the retracted position and/or other positions.

Figure 7:
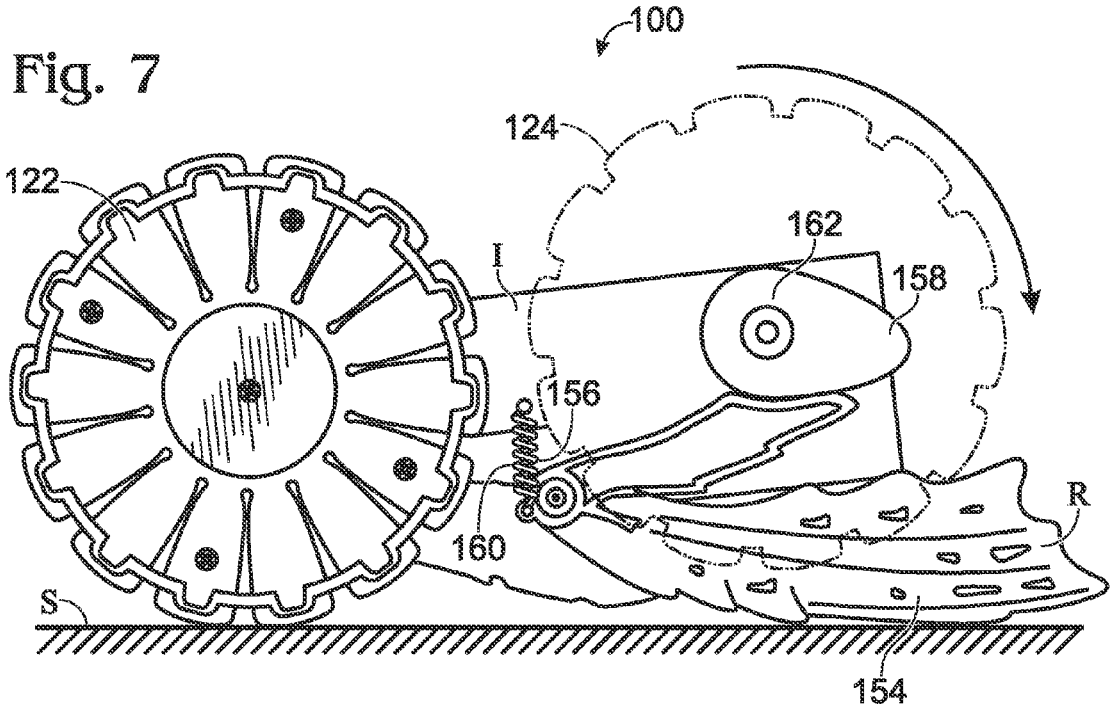
Figure 8:
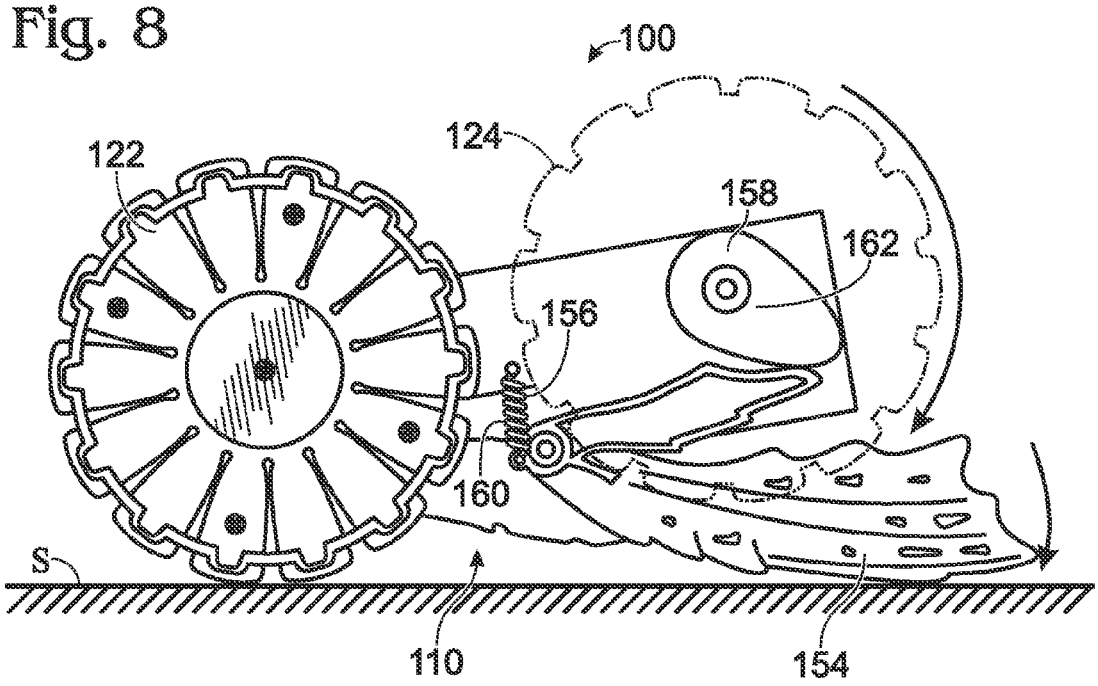
Figure 9:
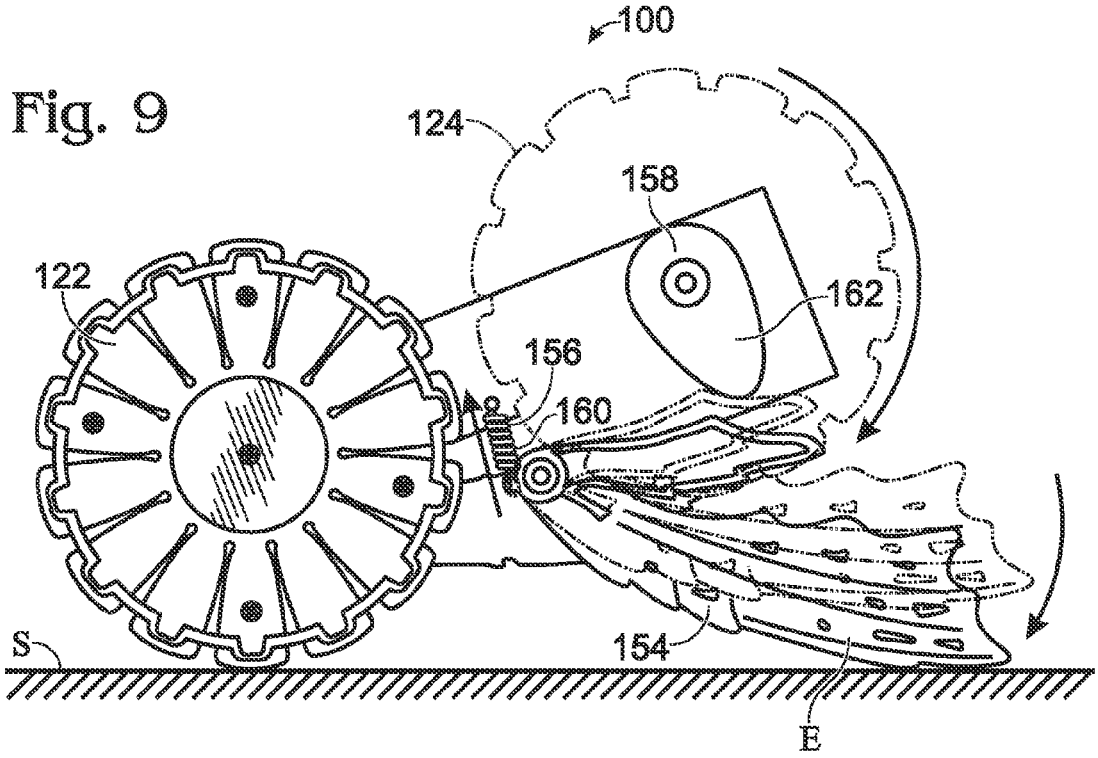

Lifter 158 may include any suitable structure configured to move stabilizer 154 from the retracted position toward the extended position, such as when the body is in the inverted position. For example, lifter 158 may be in the form of a cam 162 rotatably coupled to one or more of the plurality of wheels, such as the rear wheels, as shown in FIGS. 6-9. The lifter may contact the stabilizer when the stabilizer is in the retracted position, as shown in FIGS. 6-7, and may continue to rotate with a wheel to move the stabilizer to the extended position, as shown in FIGS. 8-9.

Although lifter 158 is shown to be in the form of a cam, the lifter may alternatively, or additionally, be in the form of any suitable structure. Additionally, although lifter 158 is shown to be rotatably coupled to the rear wheel, the lifter may additionally, or alternatively, be rotatably coupled to the front wheel. Moreover, although lifter 158 is shown to be rotatably coupled to one or more of the plurality of wheels, the lifter may alternatively, or additionally, be coupled to the control assembly, the steering assembly, and/or other components of the toy vehicle. For example, control assembly 108 may allow a user to activate lifter 158 independent of the rotation of the wheels.

In some embodiments, stabilizing assembly 110 may be further configured to stabilize the toy vehicle in the wheelie position. For example, stabilizer 154 may be configured to contact the support surface when the toy vehicle is in the wheelie position. Although toy vehicle 100 is shown to include two stabilizing assemblies 110, the toy vehicle may have any suitable number of stabilizing assemblies, such as one, three, or four stabilizing assemblies.

Figure 10:
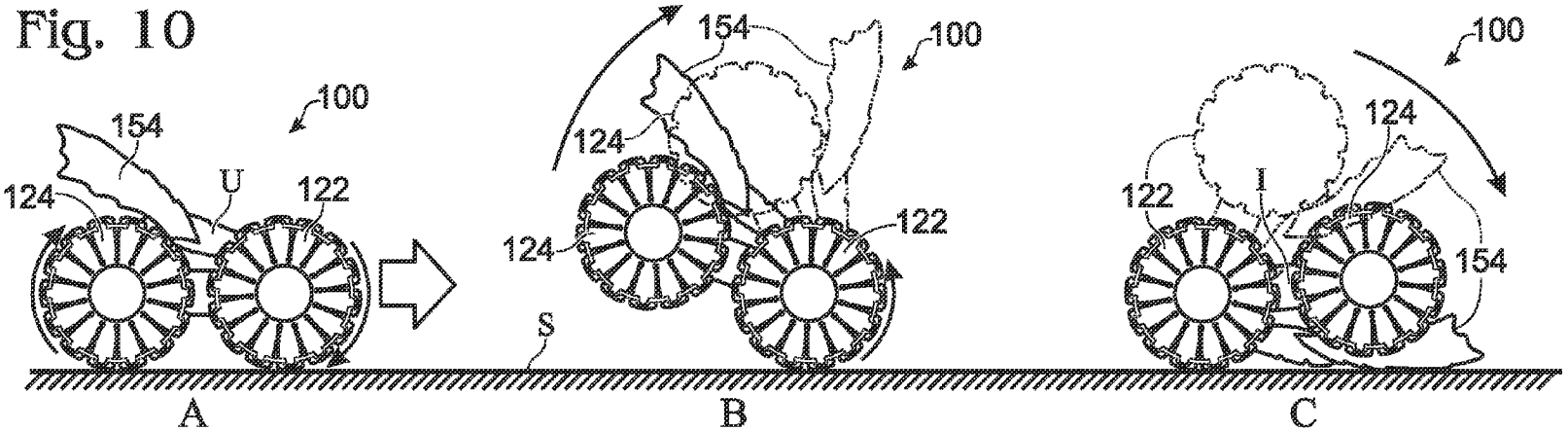
FIG. 10 shows side views of the toy vehicle of FIG. 2 as the toy vehicle moves from an upright position to an inverted position on a support surface.

In operation, the toy vehicle may be configured to move in any suitable directions. As shown in FIG. 10, the toy vehicle may be moved from upright position U toward and/or to inverted position I. At A, the toy vehicle may be moved forward by rotating the front and/or rear wheel(s) in a clockwise direction. At B, while the toy vehicle is moving in a forward direction, one or both front wheels may be rotated in a counter-clockwise direction. The momentum of the toy vehicle in the forward direction may then cause a rear portion of the toy vehicle to rotate in a clockwise direction, which may lead to the toy vehicle in the inverted position at C.

Although some of the steps above involve rotation of only the front and/or rear wheel(s), in some embodiments those steps may involve rotation of both the front and rear wheel(s). Additionally, the steps discussed above may be performed in different sequences and in different combinations, not all steps being required for all embodiments of the toy vehicle.

Figure 11:
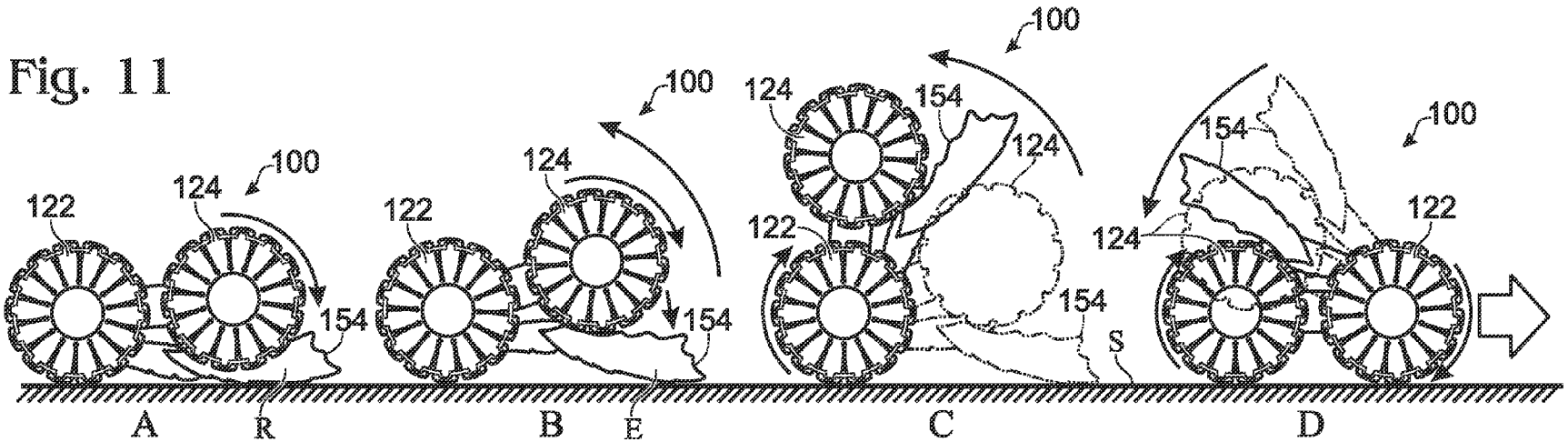
FIG. 11 shows side views of the toy vehicle of FIG. 2 as the toy vehicle moves from an inverted position to an upright position on a support surface.

As shown in FIG. 11, the toy vehicle may be moved from inverted position I toward and/or to upright position U. From the inverted position, one or both rear wheels may be rotated in a clockwise direction at A. At B, rotating one or both rear wheels may cause the lifter(s) to move the stabilizer(s) from retracted position R toward and/or to extended position E. At C, (1) movement of the stabilizer(s) toward and/or to the extended position and/or (2) movement of one or both front wheels in a clockwise direction may cause a rear portion of the toy vehicle to rotate in a counter-clockwise direction, which may lead to the toy vehicle in the upright position at D.

Although some of the steps above involve rotation of only the front and/or rear wheel(s), in some embodiments those steps may involve rotation of both the front and rear wheel(s). Additionally, the steps discussed above may be performed in different sequences and in different combinations, not all steps being required for all embodiments of the toy vehicle.

FIG. 12 shows that the toy vehicle may be moved from upright position U to wheelie position W. At A, the front and/or rear wheel(s) may be rotated in a clockwise direction to move the toy vehicle in a reverse direction. At B, while the toy vehicle is moving in the reverse direction, one or both rear wheels may be rotated in a counter-clockwise direction, which may rotate a front portion of the toy vehicle in a clockwise direction. Rotation of the front portion of the toy vehicle in the clockwise direction may lead to moving the toy vehicle to the wheelie position at C.

Although some of the steps above involve rotation of only the front and/or rear wheel(s), in some embodiments those steps may involve rotation of both the front and rear wheel(s). Additionally, the steps discussed above may be performed in different sequences and in different combinations, not all steps being required for all embodiments of the toy vehicle.

FIG. 13 shows that the toy vehicle may be rotated in wheelie position W. In the wheelie position, one rear wheel may be rotated in a clockwise direction while the other rear wheel may be rotated in a counter-clockwise direction, which may lead to the toy vehicle rotating in a clockwise or counter-clockwise direction (depending on which rear wheel is rotated in the clockwise direction and which rear wheel is rotated in the counter-clockwise direction).

Although some of the steps above involve rotation of only the front and/or rear wheel(s), in some embodiments those steps may involve rotation of both the front and rear wheel(s). Additionally, the steps discussed above may be performed in different sequences and in different combinations, not all steps being required for all embodiments of the toy vehicle.

The disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any claim recites "a" or "a first" element or the equivalent thereof, such claim should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

What is claimed is:

1. A toy vehicle configured to move across a support surface, comprising:

a body having a top portion and a bottom portion;

a plurality of wheels rotatably mounted to the body and configured to rotatably support the body on the support surface in a plurality of positions including an upright position in which the bottom portion is adjacent the support surface and the top portion is spaced from the support surface relative to the bottom portion, and an inverted position in which the top portion is adjacent the support surface and the bottom portion is spaced from the support surface relative to the top portion, wherein less than all of the plurality of wheels rotatably support the body on the support surface when the body is in the inverted position; and a stabilizing mechanism mounted to the body, wherein the stabilizing mechanism includes:

at least one stabilizer pivotally connected to the body and configured to pivot between a retracted position in which the at least one stabilizer is adjacent the body, and an extended position in which the at least one stabilizer is spaced from the body relative to the retracted position, the at least one stabilizer being configured to move to the retracted position when the body is in the inverted position, and at least one lifter rotatably coupled to one or more wheels of the plurality of wheels such that the at least one lifter rotates with the one or more wheels, the at least one lifter being configured, only when the at least one stabilizer is in the retracted position, to directly engage the at least one stabilizer and to move the at least one stabilizer toward the extended position.

2. The toy vehicle of claim 1, wherein the stabilizing mechanism further includes a bias assembly configured to urge the at least one stabilizer toward the extended position.

3. The toy vehicle of claim 2, wherein the at least one stabilizer is configured to move to the retracted position against the urging of the bias assembly when the body is in the inverted position.

4. The toy vehicle of claim 1, wherein the plurality of wheels include front wheels and rear wheels, and the plurality of positions includes a wheelie position in which only the rear wheels rotatably support the body on the support surface, wherein the stabilizing mechanism is further configured to stabilize the body in the wheelie position.

5. The toy vehicle of claim 4, wherein the at least one stabilizer is configured to contact the support surface when the body is in the wheelie position.

6. The toy vehicle of claim 1, further comprising a drive assembly configured to receive driving inputs from a user and to convey the driving inputs to at least one wheel of the plurality of wheels.

7. The toy vehicle of claim 6, further comprising a control assembly configured to receive the driving inputs from the user and to provide the driving inputs to the drive assembly.

8. The toy vehicle of claim 7, wherein the control assembly includes a remote control receiver configured to be in control communication with the drive assembly, and to receive the driving inputs from the user from a remote control transmitter.

9. The toy vehicle of claim 6, wherein the plurality of wheels includes at least two pairs of a front wheel and a rear wheel.

10. The toy vehicle of claim 9, wherein the drive assembly is configured to selectively and independently drive each of the at least two pairs of a front wheel and a rear wheel.

11. A toy vehicle configured to move across a support surface, comprising:

a body having a top portion and a bottom portion;

a plurality of wheels rotatably mounted to the body and configured to rotatably support the body on the support surface in a plurality of positions including an upright position in which the bottom portion is adjacent the support surface and the top portion is spaced from the support surface relative to the bottom portion, and in an inverted position in which the top portion is adjacent the support surface and the bottom portion is spaced from the support surface relative to the top portion, the plurality of wheels including front wheels and rear wheels, wherein only the front wheels rotatably support the body on the support surface when the body is in the inverted position; and a stabilizing mechanism mounted to the body, wherein the stabilizing mechanism includes:

at least one stabilizer pivotally connected to the body and configured to pivot between a retracted position in which the at least one stabilizer is adjacent the body, and an extended position in which the at least one stabilizer is spaced from the body relative to the retracted position, the at least one stabilizer being configured to move to the retracted position when the body is in the inverted position, and at least one lifter rotatably coupled to one or more wheels of the rear wheels such that the at least one lifer rotates with the one or more wheels, the at least one lifter being configured, only when the at least one stabilizer is in the retracted position, to directly engage the at least one stabilizer and to move the at least one stabilizer toward the extended position.

12. The toy vehicle of claim 11 , wherein the stabilizing mechanism further includes a bias assembly configured to urge the at least one stabilizer toward the extended position, and wherein the at least one stabilizer is configured to move to the retracted position against the urging of the bias assembly when the body is in the inverted position.

13. The toy vehicle of claim 11, wherein the plurality of positions include a wheelie position in which only the rear wheels rotatably support the body on the support surface, wherein the stabilizing mechanism is further configured to stabilize the body in the wheelie position.

14. The toy vehicle of claim 13, wherein the at least one stabilizer is configured to contact the support surface when the body is in the wheelie position.

15. A toy vehicle configured to move across a support surface, comprising:

a body having a top portion and a bottom portion;

a plurality of wheels rotatably mounted to the body and configured to rotatably support the body on the support surface in a plurality of positions including an upright position in which the bottom portion is adjacent the support surface and the top portion is spaced from the support surface relative to the bottom portion, and in an inverted position in which the top portion is adjacent the support surface and the bottom portion is spaced from the support surface relative to the top portion, the plurality of wheels including front wheels and rear wheels, wherein the rear wheels do not rotatably support the body on the support surface when the body is in the inverted position;

a drive assembly configured to receiving driving inputs from a user and to convey the driving inputs to one or more wheels of the plurality of wheels; and a stabilizing mechanism mounted to the body, wherein the stabilizing mechanism includes:

one or more stabilizers pivotally connected to the body and configured to pivot between a retracted position in which the one or more stabilizers are adjacent the body, and an extended position in which the one or more stabilizers are spaced from the body relative to the retracted position, the one or more stabilizers being configured to move to the retracted position when the body is in the inverted position, and one or more lifters rotatably coupled to one or more wheels of the plurality of wheels such that the one or more lifters rotate with the one or more wheels, the one or more lifters being configured, only when the one or more stabilizers are in the retracted position, to directly engage the one or more stabilizers and to move the one or more stabilizers toward the extended position.

16. The toy vehicle of claim 1, wherein the at least one stabilizer is configured to move the body from a first position in which the body is adjacent the support surface, to a second position in which the body is spaced from the support surface relative to the first position when the at least one stabilizer moves from the retracted position to the extended position.

* * * * *